US006512325B1

(12) United States Patent
Lee

(10) Patent No.: US 6,512,325 B1
(45) Date of Patent: Jan. 28, 2003

(54) SHADOW MASK FOR COLOR CATHODE RAY TUBE HAVING A VERTICAL PITCH DEFINED BY MULTIPLE MATHEMATICAL FUNCTIONS

(75) Inventor: Jae Ho Lee, Taegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/340,046

(22) Filed: Jun. 28, 1999

(30) Foreign Application Priority Data

Jun. 29, 1998 (KR) ..... 98-25048

(51) Int. Cl.[7] ..... H01J 29/80
(52) U.S. Cl. ..... 313/402; 313/403; 313/408
(58) Field of Search ..... 313/402, 403, 313/407, 408, 472

(56) References Cited

U.S. PATENT DOCUMENTS 3,686,525 A * 8/1972 Naruse et al. ..... 313/402
4,210,842 A * 7/1980 Nakayama et al. ..... 313/403
4,638,212 A * 1/1987 Nakamura ..... 313/408
4,751,425 A 6/1988 Barten ..... 313/403
4,794,299 A * 12/1988 Chiodi et al. ..... 313/402
4,893,054 A * 1/1990 Kobayashi ..... 313/408
5,000,711 A * 3/1991 Marks et al. ..... 445/47
5,055,736 A * 10/1991 Yun et al. ..... 313/402
5,534,746 A * 7/1996 Marks et al. ..... 313/408
5,633,558 A * 5/1997 Watanabe et al. ..... 313/402
5,689,149 A * 11/1997 Welles, Jr. et al. ..... 313/402
5,877,586 A * 3/1999 Aibara ..... 313/402
6,064,147 A * 5/2000 Hosotani ..... 313/463
6,157,120 A * 12/2000 Tseng et al. ..... 313/402

FOREIGN PATENT DOCUMENTS

JP 06275206 A * 9/1991

* cited by examiner

*Primary Examiner*—Vip Patel
*Assistant Examiner*—Kevin Quarterman
(74) *Attorney, Agent, or Firm*—Fleshner & Kim, LLP

(57) ABSTRACT

An improved shadow mask for a color cathode ray tube (CRT) in which a vertical pitch of the apertures of the shadow mask is defined by a plurality of mathematical functions from a center of the shadow mask to an edge of an effective area thereof, so that the vertical pitch increases towards the effective area end point. Thus, the shadow mask for the color CRT according to the present invention enlarges the color purity margins at corners of a screen and accordingly improves the color purity. Further, the shadow mask according to the present invention can be applied to the cathode ray tube for the computer monitor (CDT).

8 Claims, 9 Drawing Sheets

SHADOW MASK FOR COLOR CATHODE RAY TUBE HAVING A VERTICAL PITCH DEFINED BY MULTIPLE MATHEMATICAL FUNCTIONS

BACKGROUND OF THE INVENTION

1. Field of the Invention

The present invention relates to a shadow mask for a color cathode ray tube (CRT), and more particularly to a shadow mask for a color CRT that improves the color purity at corners of a screen by varying a vertical pitch of the shadow mask.

2. Description of the Conventional Art

FIG. 1 is a diagram illustrating a color CRT. As shown therein, the color CRT includes a panel 2 to an inner surface of which a fluorescent screen 1 of red (R), green (G) and blue (B) is applied, a funnel 3 attached to a rear portion of the panel 2, an electron gun 5 mounted into a neck 4 of the funnel 3 and emitting electron beams 6, a deflection yoke 7 deflecting the electron beams 6 emitted from the electron gun 5 to an entire area of the screen, a shadow mask 8 sorting colors of the electron beams, and a frame 9 supporting the shadow mask 8 to have a regular interval with the inner surface of the panel 2.

FIG. 2 is a diagram detailedly illustrating the shadow mask 8. as shown therein, the shadow mask 8 has a plurality of apertures 10 to transmit the electron beams 6. The apertures in the shadow mask 8 are arranged through the entire area of the shadow mask from a center to peripheral portions of the shadow mask 8 at a regular vertical pitch Pv or a variable vertical pitch Pv which is determined in a predetermined function.

FIGS. 3A and 3B respectively illustrate an effective area of a shadow mask, wherein FIG. 3A illustrates a shadow mask having apertures arranged at a uniform vertical pitch and FIG. 3B illustrates a shadow mask having apertures arranged at a variable vertical pitch. Here, in each of FIGS. 3A and 3B, O(0,0) is a center coordinate of the shadow mask, E(Xe, Ye) is an effective area and point of the shadow mask, Pv0 is an initial value of a vertical pitch at the center point O(0,0) of the shadow mask, and Pvc indicates the vertical pitch at a corner of the shadow mask.

In the color CRT having the shadow mask in the conventional art, when power is supplied, the electron beams 6 emitted from the electron gun 5 are deflected to the whole area of the screen. While being transmitted through the dots 10 of the shadow mask 8, the deflected beams 6 are sorted and strike the fluorescent screen 1, so that an image is reproduced. Here, since the electron gun 5 is an in-line type and the shadow mask 8 and the panel 2. are gently curved, when striking the fluorescent screen 1 provided at the inner surface of the panel 2, the electron beams 6 emitted from the electron gun 5 strike pixels R, G and B being slanted at an angle of predetermined degrees, as shown in FIG. 4, such a phase being called an electron beam tilt.

In the electron beam tilt, a tilt angle enlarges as it goes towards corners of the screen. Here, the greater the tilt angle becomes, the closer becomes a distance Prb between an electron beam striking a red fluorescent body and an electron beam striking a blue fluorescent body so that although the electron beam slightly erroneously lands, it easily invades another fluorescent body, which results in the deterioration of color purity. That is, the distance Prb between the electron beam striking the red fluorescent body and the electron beam striking the blue fluorescent body is so close compared with a distance between centers of the electron beams that strike green fluorescent bodies, that the electron beam easily invades the other fluorescent bodies, thus lowering in the color purity.

In recent years, an electric field of the CRT has been made small. Therefore, the electron beam tilt angle at each corner of the screen becomes larger. Accordingly, as the tilt angle of the electron beam enlarges, the color purity of the corners of the screen is seriously worsened.

SUMMARY OF THE INVENTION

Accordingly, the present invention is directed to a shadow mask of a color CRT which obviates the problems and disadvantages in the conventional art.

An object of the present invention is to provide a shadow mask of a color CRT that prevents deterioration of color purity at corners of a screen.

To achieve these and other advantages and in accordance with the purpose of the present invention, as embodied and broadly described herein, in a shadow mask for a color cathode ray tube (CRT) with plurality of apertures through which electron beams from an electron gun can pass which has a regular interval with an inner surface of a panel by a frame and sorts colors by the electron beams, there is provided an improved shadow mask for the color CRT, wherein a vertical pitch of the apertures of the shadow mask is defined by a plurality of increase functions from a center of the shadow mask to an edge of an effective area thereof, so that the vertical pitch increases towards the effective area end point.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DESCRIPTION OF THE INVENTION

Reference will now be made in detail to the preferred embodiments of the present invention, examples of which are illustrated in the accompanying drawings.

Figure 1:
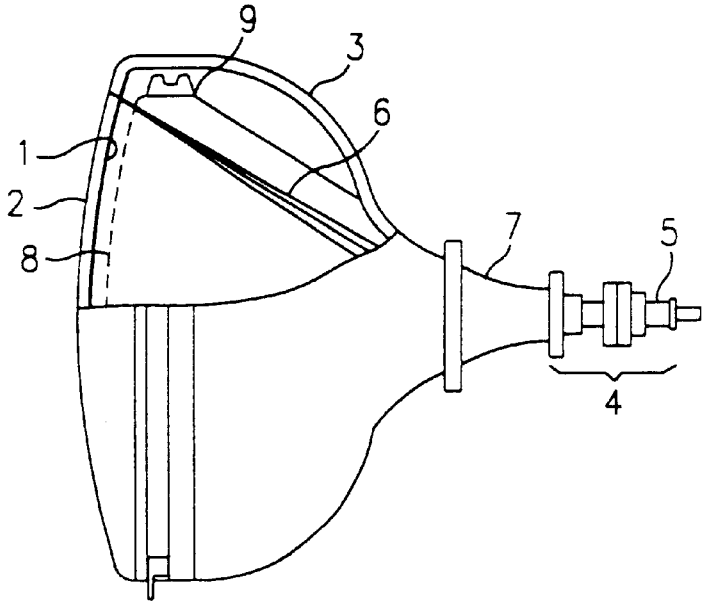
FIG. 1 CONVENTIONAL ART
FIG. 1 is a diagram illustrating a general color CRT.
Figure 2:
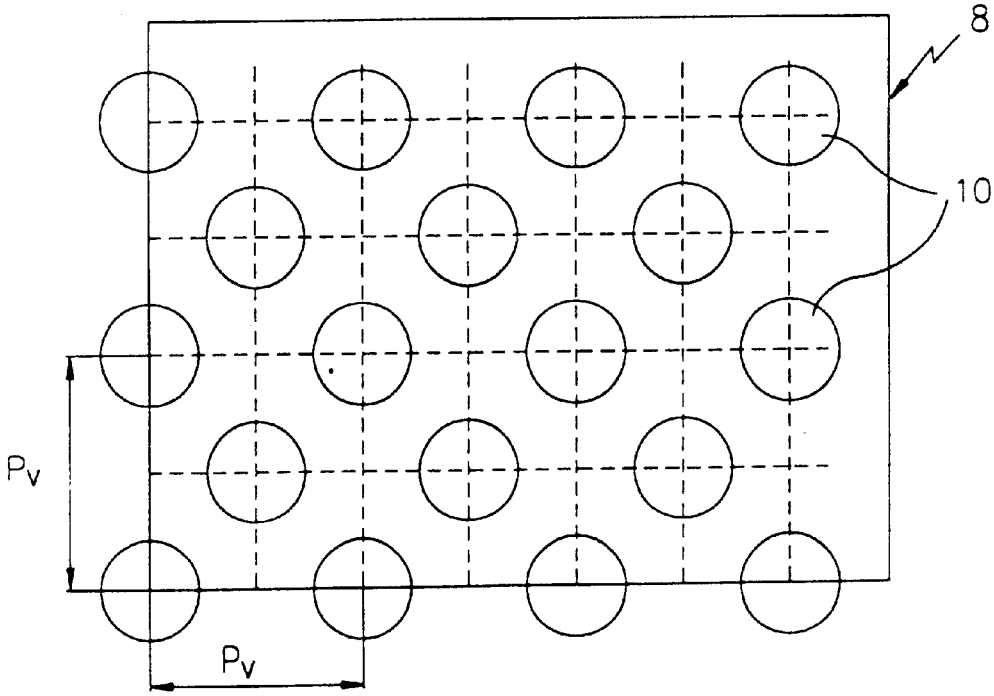
FIG. 2 CONVENTIONAL ART
FIG. 2 is a diagram illustrating apertures in a conventional shadow mask.
Figure 3A:
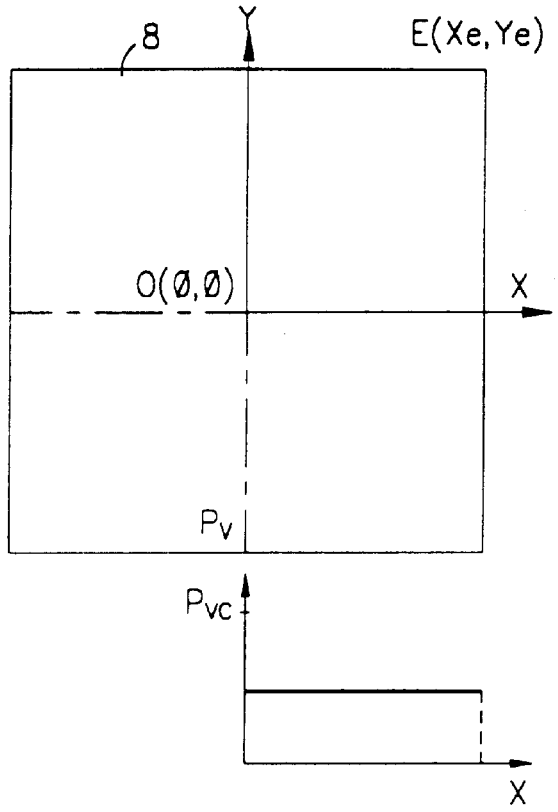
FIG. 3A CONVENTIONAL ART
FIG. 3A illustrates that apertures arranged in an effective area of a conventional shadow mask have a uniform vertical pitch and FIG. 3B illustrates that apertures arranged in an effective area of a conventional shadow mask have a variable vertical pitch.
Figure 3B:
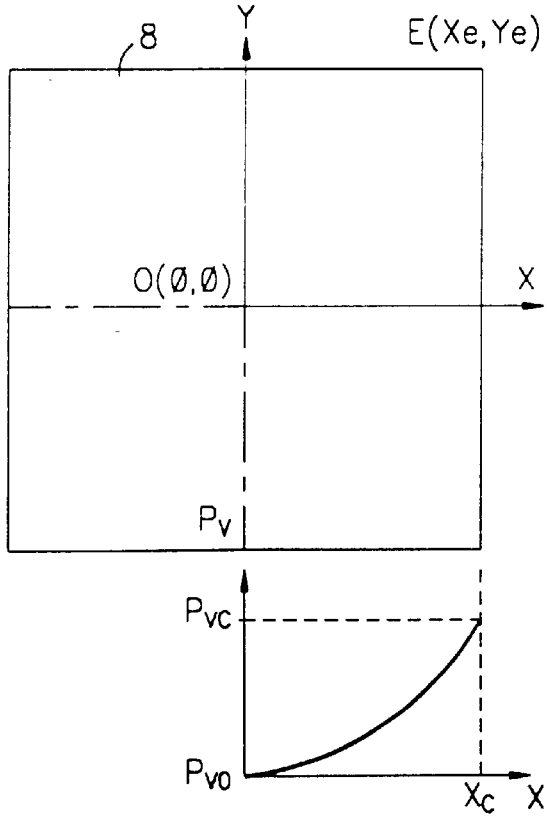
FIG. 3B CONVENTIONAL ART
Figure 4:
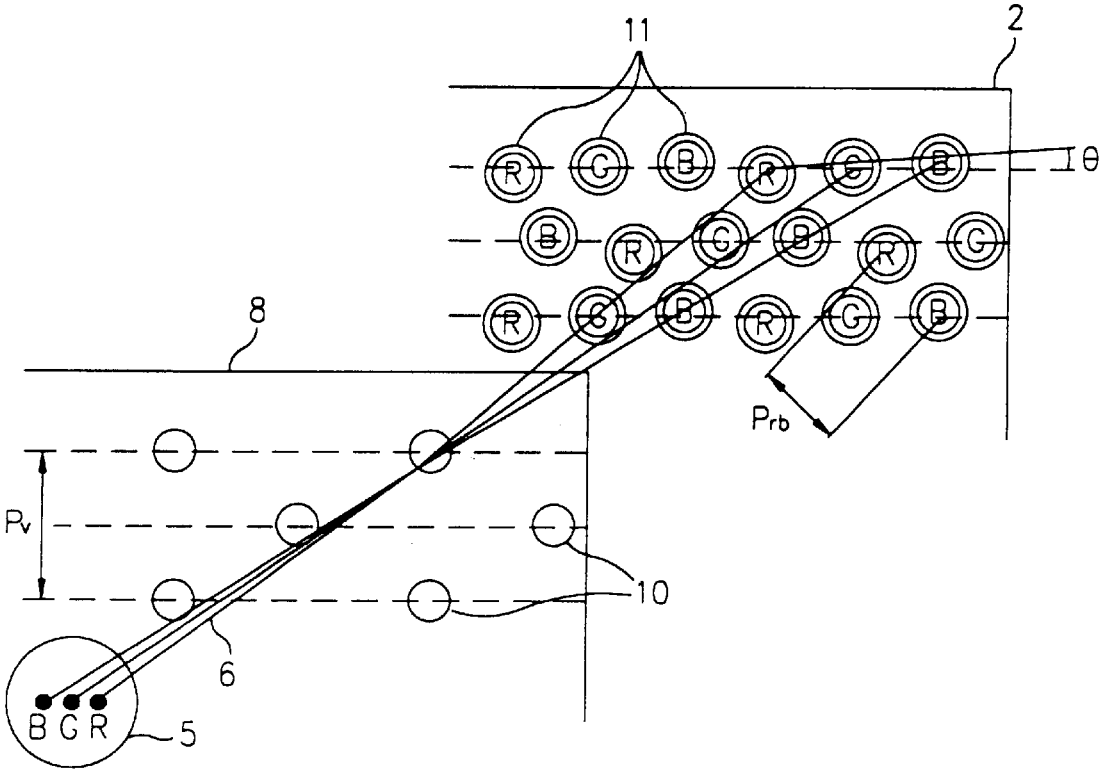
FIG. 4 CONVENTIONAL ART
FIG. 4 is a diagram illustrating which electron beams passing through apertures of a conventional shadow mask in a color CRT strike R, G, B pixels.
Figure 5:
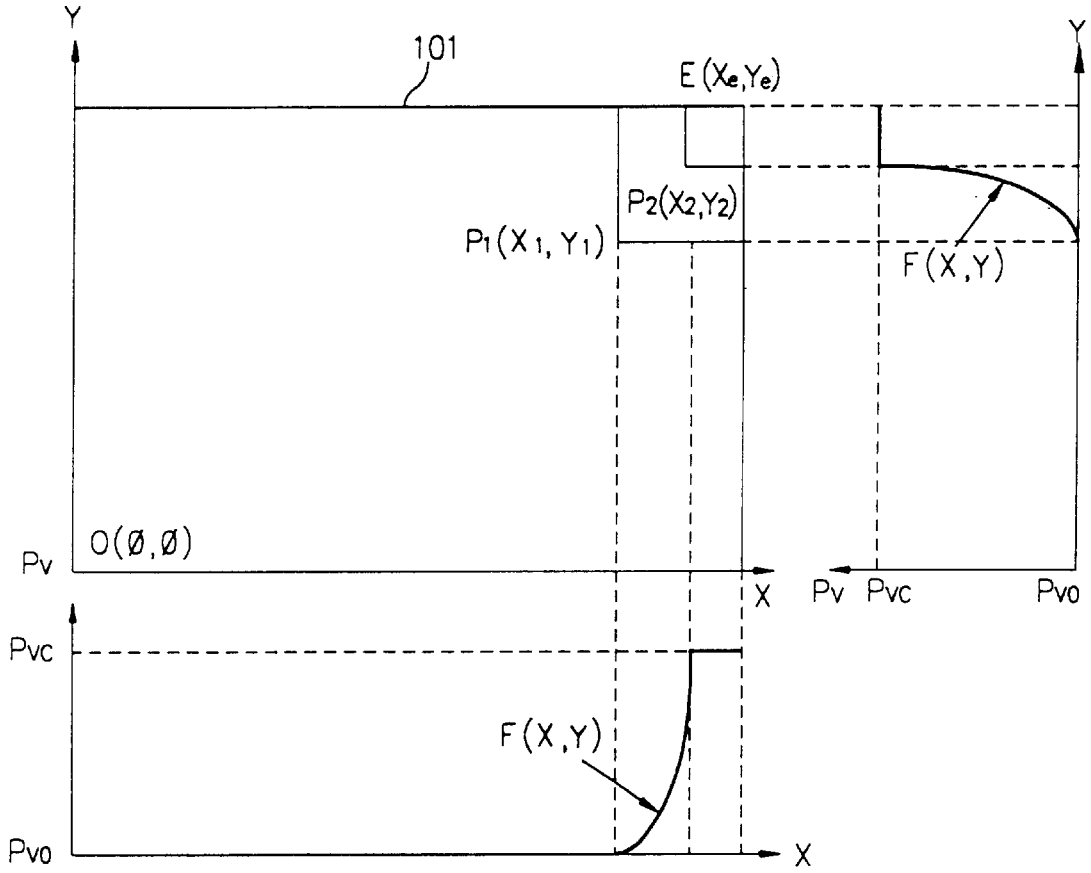
FIG. 5 is a graph illustrating a vertical pitch arrangement of shadow mask apertures for a color CRT according to a first embodiment of the present invention.

FIG. 5 illustrates in a graphic form a vertical pitch arrangement of shadow mask apertures for a color CRT according to a first embodiment of the present invention, wherein vertical pitches are arranged in three different parts.

Particularly, when a center point of a shadow mask 101 is O(0,0), in a first region (X<x1 and Y<yl) defined between the point O(0,0) and a first predetermined point P1 (x1, y1) a vertical pitch of the apertures is uniformly arranged as an initial value Pv0 thereof, in a second region (x1≦X≦x2 and y1≦Y≦y2) defined between the first predetermined point P1(x1,y1) and a second predetermined point P2(x2,y2) the apertures have a variable vertical pitch wherein the vertical pitch of the apertures increases as X increasingly varies, and in a third region (Xe≧X≧x2 and Ye≧Y≧y2) defined between the second predetermined point P2(x2,y2) and an end point E(Xe,Ye) of an effective area of the shadow mask 101 the vertical pitch of the apertures has a uniformly value determined at the end point of the second region.

Here, it is noted that coordinates of X1 and Y1 of the first point P1(x1,y1) are approximately in points that correspond to about 95% of Xe and Ye, respectively, of the effective area end point E(Xe,Ye) with respect to the center point O(0,0) of the shadow mask 101.

More specifically, in the effective area of the shadow mask of the color CRT according to the present invention, the vertical pitches arranged in the above regions can be expressed as follows.

The vertical pitch Pv of the first region (X<x1 and Y<y1) is $$Pv=Pv0 \tag{1}$$

The variable vertical pitch Pvx to the X axis in the second region (x1≦X≦x2 and y1≦Y≦y2) is $$Pvx=F(X)=Pv0(1+\alpha X^n) \tag{2}$$

and the variable vertical pitch Pvx to the Y axis therein is $$Pvy=F(Y)=Pv0(1+\beta Y^m) \tag{3}$$

Accordingly, from the formulas (2) and (3), the variable vertical pitch Pv in the second region (x1≦X≦x2 and y1≦Y≦y2) can be obtained as follows.

$$Pv=F(X,Y)=Pv0(1+\alpha X^n)(1+\beta Y^m) \tag{4}$$

In the third region (Xe≧X≧x2 and Ye≧Y≧y2), a vertical pitch value is maintained as the vertical pitch value finally determined at the second point P2 and thus a variable vertical pitch function thereof is $$Pv=F(x2,y2)=Pv0(1+\alpha(x2)^n)(1+\beta Y(y2)^m)=Pvc \tag{5}$$

Wherein, Pv is a pitch in the vertical direction of the apertures and Pvc is a vertical pitch at a corner of the shadow mask, and Pv0 is an initial vertical pitch value of the shadow mask. α and β are positive coefficients, n and m are multipliers of X and Y, respectively, and X and Y are variables of the X and Y axes, respectively, of the shadow mask 101.

Figure 6:
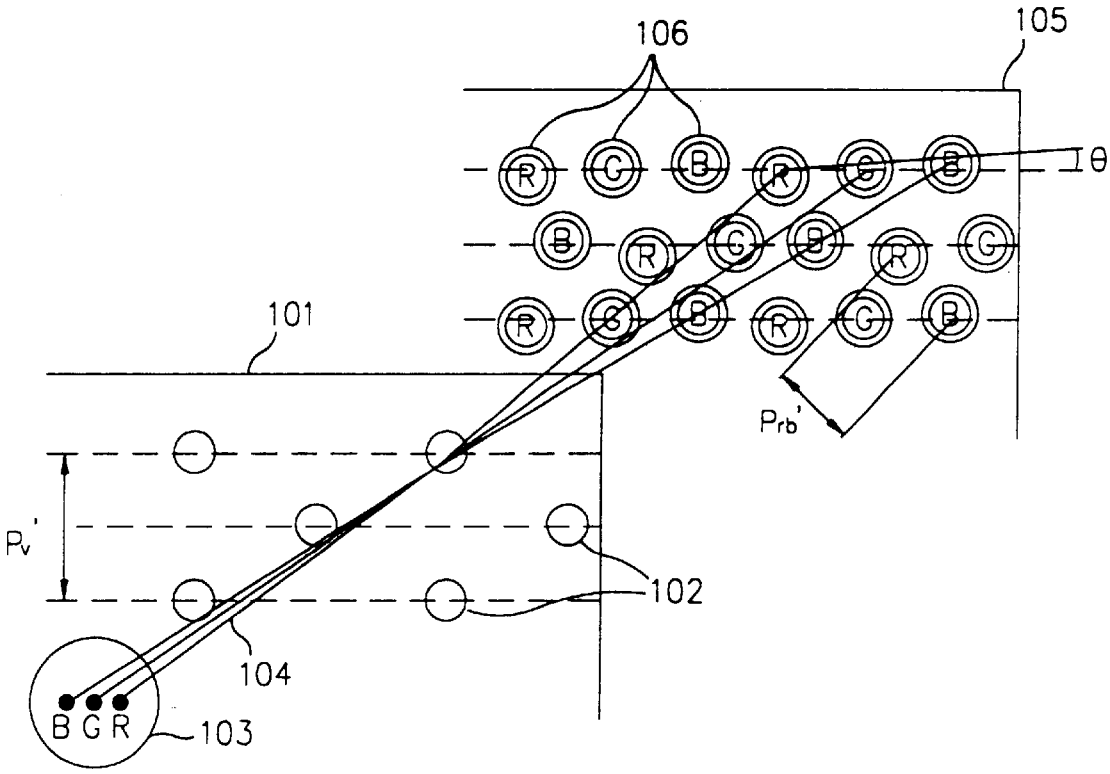
FIG. 6 is a diagram illustrating which electron beams passing through apertures of a shadow mask in a color CRT according to the present invention strike R, G, B pixels.

Thus, according to the first embodiment of the present invention, when setting a vertical pitch of each corner area of the shadow mask 101 at a large value (that is, parts which are about 99% of lengths of the X and Y axes, respectively, from the center point to the effective area end point of the shadow mask 101), as shown in FIG. 6, when the R, G, and B electron beams 104 pass through the apertures 102 of the shadow mask 101 and then strike the fluorescent dots 106 at the inner surface of the panel 105, an interval Prb' between the R beam and B beam can be largely obtained and thus the color purity at the corners of the shadow mask 101 can be improved.

However, if the vertical pitch of the shadow mask 101—is exceedingly enlarged, resolution of the entire screen may deteriorate. Thus, the vertical pitch must be variously arranged in accordance with a predetermined coordinate of the effective area of the shadow mask 101.

Now, a method of defining the variable vertical pitch will be described.

When the distance between the R electron beam and the B electron beam is 'Prb' at the corner of the screen, the objective resolution and color purity margins at the four corners of the screen can be obtained by determining the vertical pitches Pvc of the four corners of the shadow mask 101 and radically reducing the vertical pitches Pvc as a predetermined function for thereby converging to the uniform pitch Pv0.

Figure 7A:
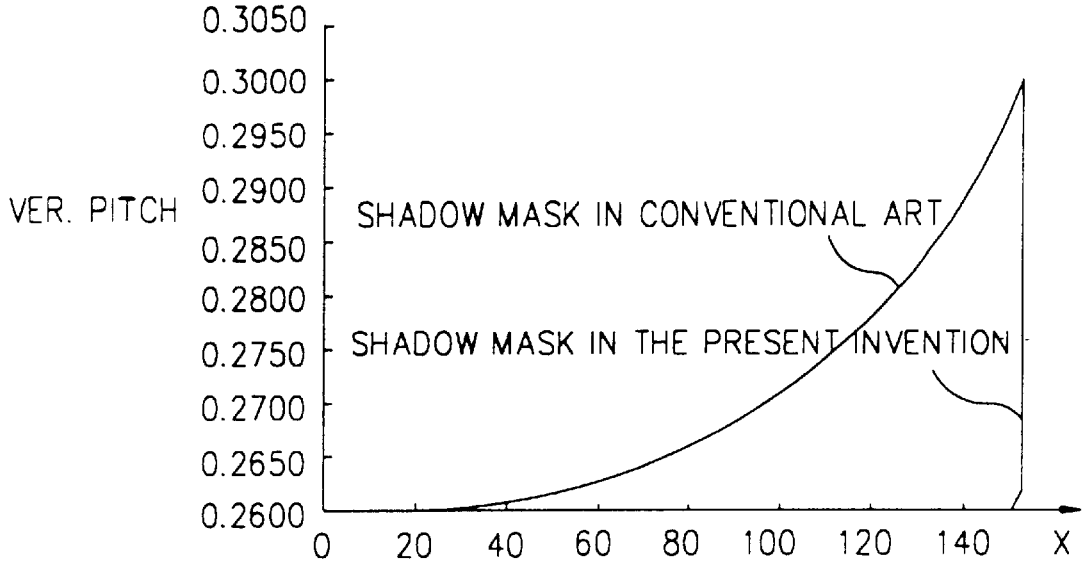
FIG. 7A is a graph illustrating vertical pitch arrangements of the shadow mask according to the present invention and the conventional art, respectively, as X increases from a center point of the shadow mask in a quarter of the shadow mask of a shadow mask
Figure 7B:
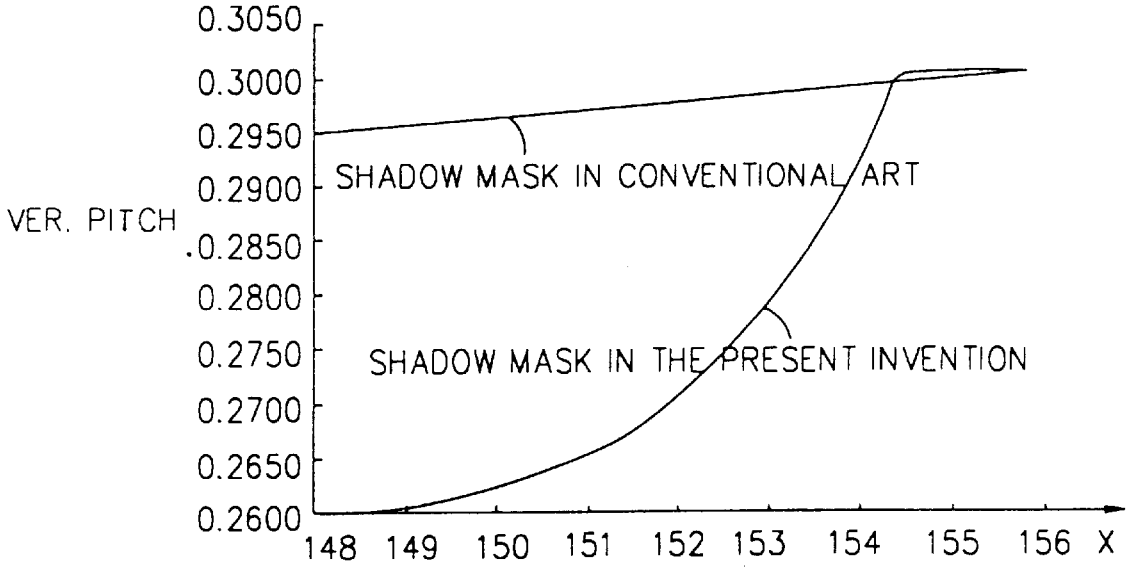
FIG. 7B is a graph illustrating vertical pitch arrangements of the shadow mask of the present invention and the conventional art, respectively, as X increases in a peripheral part of the shadow mask.

FIG. 7A is a graph which illustrates vertical pitch arrangements of the shadow mask according to the present invention and the conventional art, respectively, as X increases from a center point of the shadow mask in a quarter of the shadow mask of a 17"100 degree CDT to which the embodiment of the present invention is applied, while FIG. 7B is a graph illustrating vertical pitch arrangements of the shadowmask of the present invention and the conventional art, respectively, as X increases at a peripheral part of the shadowmask.

That is, the R beam and B beam get closed and accordingly the color purity margin deteriorates which results in the serious electron beam tilt occurring in a part which is about 5 pitches distanced from the end point of the effective area of the shadow mask 10 (that is, a point which is about 99% of lengths of the X and Y axes, respectively, from the center point of the shadow mask to the end point of the effective area of the shadowmask). Therefore, FIGS. 7A and 7B show the vertical pitch arrangement of the shadow mask according to the embodiment of the present invention which improves such an electron beam tilt and the vertical pitch arrangement of the shadow mask in the conventional art.

Here, it is noted that a vertical pitch of the shadow mask according to the conventional art is expanded as the cube of a variable X and a vertical pitch thereof of the present invention is expanded as the cube of variables X and Y, respectively, from a predetermined coordinate P1 (x1, y1) on the shadow mask.

Specifically, as shown in FIG. 7A, the vertical pitch of the shadow mask according to the present invention uniformly maintains up to the point 147 on the X coordinate (the point which is about 95% of lengths of the X and Y axes, respectively, the point laid in an imaginary line drawn from the center point of the shadow mask to the end point of the effective area of the shadow mask), and then rapidly increases as the cube of the coordinate and FIG. 7B illustrates that the vertical pitch thereof is uniformly converged in the part where the electron beam tilt seriously occur, that is the part being about 5 pitches distanced from the end point of the effective area of the shadow mask.

Thus, according to the embodiment of the present invention, the distance between the R beam and B beam at each corner of the screen can maintain larger than the conventional art and accordingly the color purity margin can be maintained in a large value.

Figure 8:
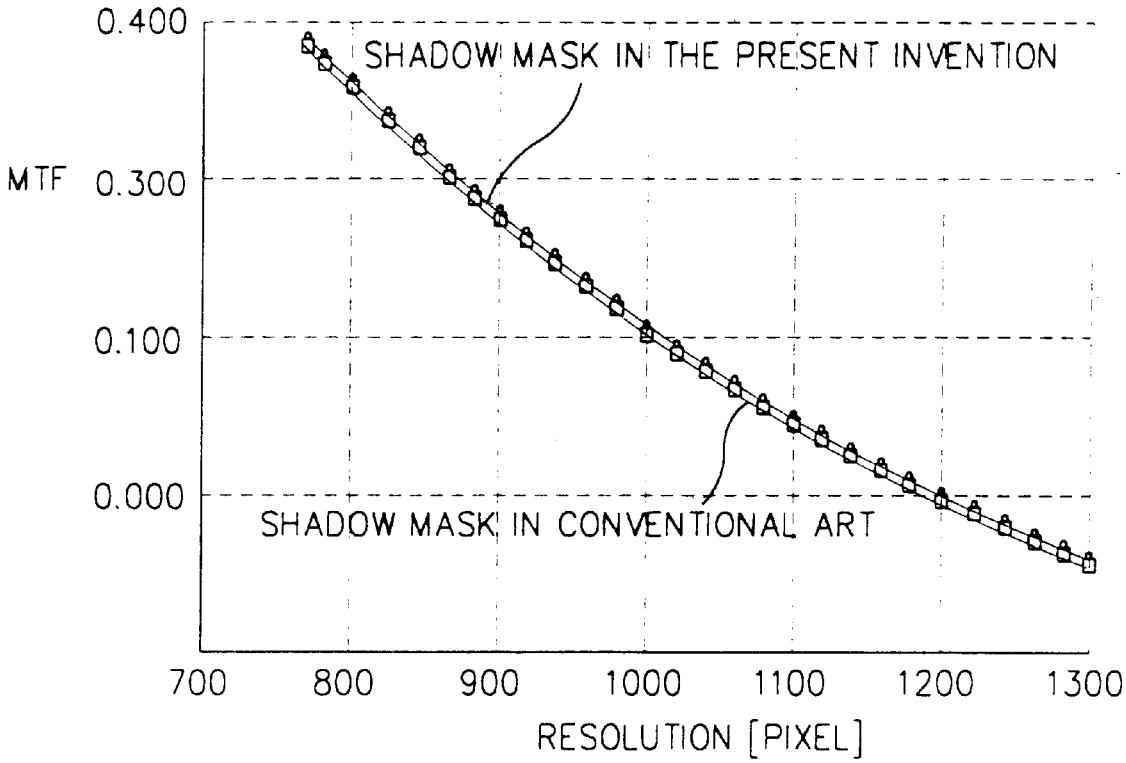
FIG. 8 is a graph illustrating modulation transfer functions according to the present invention and the conventional art in accordance with change of the resolutions at corners of a shadow mask.

FIG. 8 illustrates a modulation transfer function MTF in accordance with change of the resolution of the corners of the shadow mask according to the present invention and the conventional art.

As shown therein, it can be seen that MTF, that is, an acknowledge level at a predetermined space frequency, in the vertical pitch formula is more excellent than that of the conventional art in accordance with the vertical resolution at the screen peripheral part point according to the different pitch formulas.

Figure 9:
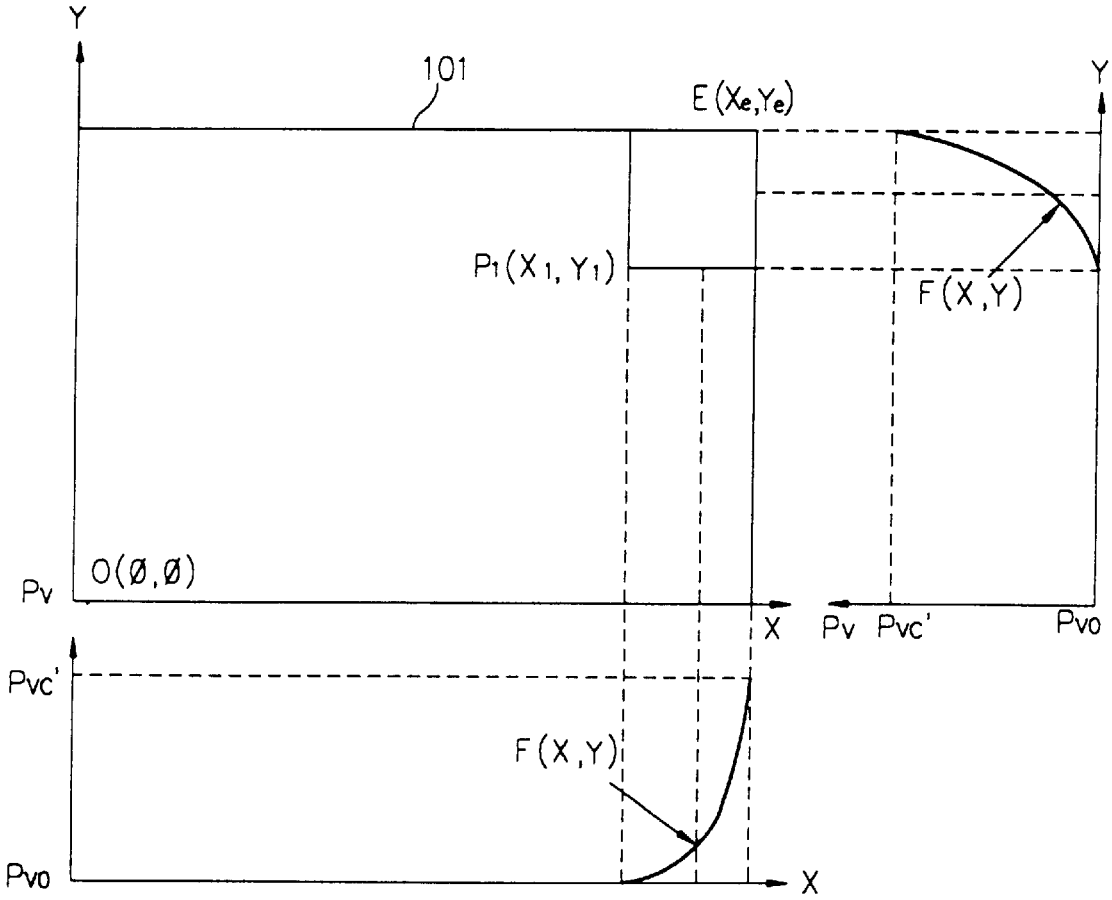
FIG. 9 is a graph illustrating a vertical pitch arrangement of shadow mask apertures for the CRT vertical pitches in accordance with a second embodiment of the present invention.

FIG. 9 illustrates a vertical pitch arrangement of shadow mask apertures for the CRT vertical pitches in accordance with a second embodiment of the present invention, wherein vertical pitches are arranged into two different parts.

When a center point of the shadow mask is O(0,0), an initial vertical pitch value uniformly maintains in a first region X<x1, Y<y1, which is defined between the center point O(0,0) and a first point P1 (x1, y1) and the vertical pitch value variably increases as it goes towards to an end point E(Xe, Ye) from the first point in a second region (Xe≧X>x1 and Ye≧Y>y1) defined between the first point P1 (x1, y1) and the effective area end point E(Xe, Ye)of the shadow mask.

Here, coordinates x1 and y1 of the first point P1 are about 95% of Xe and Ye, respectively, of the effective area end point E(Xe, Ye) with respect to the center point O(0,0) of the shadow mask 101.

More specifically, the vertical pitches arranged in the divided regions of the effective area of the shadow mask of the CRT according to the present invention can be expressed in following formulas.

The vertical pitch Pv in the first region (X<x1, Y<y1) is $$Pv=Pv0 \tag{6}$$

The variable vertical pitch Pvx to the X axis of the second region (Xe≧X≧x1 and Ye≧Y≧y1) is $$Pvx=F(X)=Pv0(1+\alpha X^{n}) \tag{7}$$

The variable vertical pitch Pvy to the Y axis of the second region (Xe≧X≧x1 and Ye≧Y≧y1)is $$Pvy=F(Y)=Pv0(1+\beta Y^{m}) \tag{8}$$

The variable vertical pitch Pv of the second region can be obtained from the formulas (7) and (8) as follows.

$$Pv=F(X,Y)=Pv0(1+\alpha X^{m})(1+\beta Y^{m}) \tag{9}$$

In the above formulas, Pv is a pitch of the apertures in the vertical direction and Pv0 indicates an initial value of the vertical pitch of the shadow mask 101. α and β are positive coefficients, n and m are multipliers of X and Y, respectively, and X and Y are variables of the X and Y axes, respectively, of the shadow mask 101.

Figure 10:
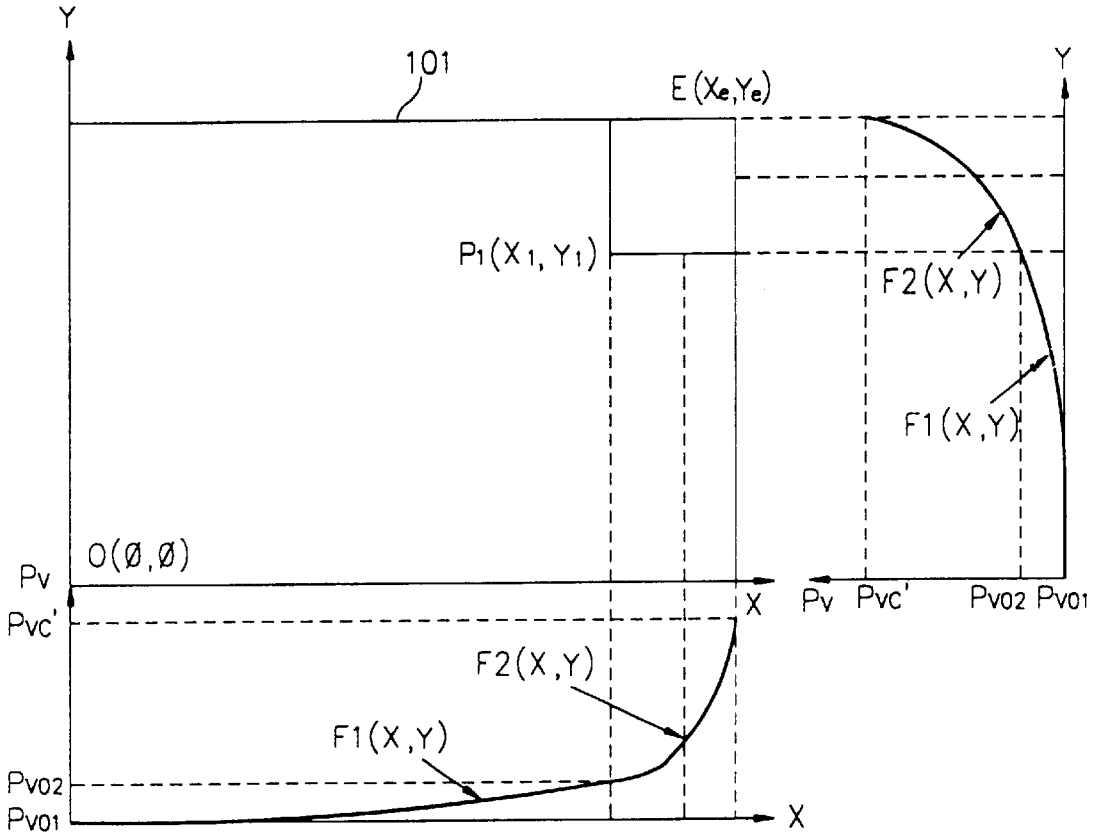
FIG. 10 is a graph illustrating a vertical pitch arrangement of shadow mask apertures for the CRT vertical pitches in accordance with a third embodiment of the present invention.

FIG. 10 illustrates a vertical pitch arrangement of shadow mask apertures for the CRT vertical pitches in accordance with a third embodiment of the present invention, wherein vertical pitches are arranged into two different parts.

When a center point of the shadow mask 101 is O(0,0), in a first region (X<x1, Y<y1) which is defined between the center point O(0,0) and a predetermined first point P1(x1, y1) the vertical pitch is arranged as a variable vertical pitch wherein a slope of the vertical pitch gently increases, and in a second region (Xe X≧x1 and Ye Y≧y1) defined between the first point P1(x1, y1) and an effective area end point of the shadow mask E(Xe, Ye) the slope of the vertical pitch considerably radically increases.

Here, coordinates x1 and y1 of the first point P1 are about 95% of Xe and Ye, respectively, of the effective area end point E(Xe, Ye) with respect to the center point O(0,0) of the shadow mask 101.

More specifically, the vertical pitches arranged in the divided regions of the effective area of the shadow mask of the CRT according to the present invention can be expressed in following formulas.

The variable vertical pitch in the first region (X<x1, Y<y1) is $$Pv=F1(X,Y)=Pv01(1+\alpha 1X^{n1})(1+\beta 1Y^{m1}) \tag{10}$$

Here, the variable vertical pitch in the first point (x1,y1) becomes $$Pv\ F1(X1,\ Y1)=Pv02$$

The variable vertical pitch of the second region (Xe≧X≧x1 and Ye≧Y≧y1) is $$Pv\ F2(X,Y)=Pv02(1+\alpha 1X^{n2})(1+\beta 2Y^{m2}) \tag{11}$$

In the above formulas, Pv is a pitch of the apertures in the vertical direction and Pv01 and PvO2 indicate initial values of the vertical pitches at the O(0,0) and the first point (x1,y1), respectively. α1, α2, β1 and β2 (α1<α2 or β1<β2) indicate positive coefficients. N1 and n2 (n1<n2) are respectively multipliers of X, ml and m2 (m1<m2) are respectively multipliers of Y, and X and Y are variables of the X and Y axes, respectively, of the shadow mask 101.

Accordingly, in the shadow mask of the present invention the vertical pitches of the apertures in the corners are variably arranged, thereby enlarging the color purity margins at the corners of the screen, which results in improvement of the color purity and also being applicable to a cathode ray tube for a computer monitor (CDT).

It will be apparent to those skilled in the art that various modifications and variations can be made in the shadow mask for the color CRT of the present invention without departing from the spirit or scope of the invention. Thus, it is intended that the present invention covers the modifications and variations of this invention provided they come within the scope of the appended claims and their equivalents.

What is claimed is:

1. A shadow mask for a color cathode ray tube (CRT), said shadow mask characterized by at least two regions, comprising:

a plurality of apertures through which electron beams from an electron gun can pass, wherein a vertical pitch of the apertures of the shadow mask in each of the at least two regions is defined by a respective and unique mathematical function, at least one of which is a nonlinear mathematical function.

2. The shadow mask according to claim 1, wherein the vertical pitch (Pv) of the shadow mask apertures in a first region, which extends from a center point O(0,0) to a first predetermined point P1(x1,y1) of the effective area end portion of the shadow mask, is a substantially constant value, the vertical pitch (Pv) of the shadow mask apertures in a second region, which extends from the first point P1(x1,y1) to a second predetermined point P2(x2,y2), is defined by a mathematical function $Pv=F(X,Y)=Pv\mathbf{0}(1+\alpha X^n)(1+\beta Y^m)$, in which the shadow mask is expressed as a rectilinear coordinate system, X and Y are variables of the X and Y axes, respectively, $x\mathbf{1}\geqq X\geqq x\mathbf{2}$ and $y\mathbf{1}\geqq Y\geqq y\mathbf{2}$, Pv0 is an initial vertical pitch value of the shadow mask, α and β are positive coefficients, and n and m are multipliers of X and Y, respectively, and the vertical pitch (Pv) of the shadow mask apertures in a third region, which extends from the second predetermined point P2(x2,y2) to the effective area end point E(Xe,Ye) of the shadow mask, is substantially the same as the vertical pitch value defined for the second predetermined point P2(x2,y2).

3. The shadow mask according to claim 2, wherein the first point P1(x1 ,y1) is in a range between $0.9Xe\geqq x\mathbf{1}\geqq 0.97Xe$ and $0.9Ye\geqq y\mathbf{1}\geqq 0.97Ye$, and the second point P2(x2,y2) is in a range between $0.99Xe\geqq x\mathbf{2}$ and $0.99Ye\geqq y\mathbf{2}$.

4. The shadow mask according to claim 1, wherein the vertical pitch (Pv) of the shadow mask apertures in a first region, which extends from a center point O(0,0) to a first predetermined point P1(x1,y1) of the effective area end portion of the shadow mask, is a substantially constant value, and wherein the vertical pitch (Pv) of the shadow mask apertures in a second region, which extends from the first predetermined point P1(x1,y1) to a shadow mask effective area end point E(Xe,Ye)), is defined by a mathematical function $Pv=F(X,Y)=Pv\mathbf{0}(1+\alpha X^n)(1+\beta Y^m)$, in which the shadow mask is expressed as a rectilinear coordinate system, X and Y are variables of the X and Y axes, respectively, $x\mathbf{1}\geqq X\geqq Xe$ and $y\mathbf{1}\geqq Y\geqq Ye$, Pv0 is an initial vertical pitch value of the shadow mask, α and β are positive coefficients, and n and m are multipliers of X and Y, respectively.

5. The shadow mask according to claim 4, wherein the first point P1(x1,y1 ) is in a range between $0.9Xe\geqq x\mathbf{1}\geqq 0.97Xe$ and $0.9Ye\geqq y\mathbf{1}\geqq 0.97Ye$.

6. The shadow mask according to claim 1, wherein the vertical pitch (Pv) of the shadow mask apertures is defined by a mathematical function $Pv=F\mathbf{1}(X,Y)=Pv\mathbf{01}(1+\alpha\mathbf{1}X^{n1})(1+\beta\mathbf{1}Y^{m1})$ in a first region, which extends from a center point O(0,0) of the shadow mask to a first predetermined point P1(x1,y1) of the effective area end portion of the shadow mask, and wherein the vertical pitch (Pv) of the shadow mask apertures in a second region, which extends from the first predetermined point P1(x1,y1) to a second predetermined point P2(x2,y2), is defined by a mathematical function $Pv=F\mathbf{2}(X,Y)=Pv\mathbf{02}(1+\alpha\mathbf{1}X^{n2})(1+\beta\mathbf{2}Y^{m2})$, in which the shadow mask is expressed as a rectilinear coordinate system, X and Y are variables of the X and Y axes, respectively, Pv01 and Pv02 are respectively initial values of the vertical pitch, α1, α2, β1, and β2 are positive coefficients, n1 and n2 are multipliers of X, and m1 and m2 are multipliers of Y.

7. The shadow mask according to claim 6, wherein $\alpha\mathbf{1}<\alpha\mathbf{2}$ or $\beta\mathbf{1}<\beta\mathbf{2}$, and $n\mathbf{1}<n\mathbf{2}$ or $m\mathbf{1}<m\mathbf{2}$, and accordingly, an increasing slope of the vertical pitch in the first region is smaller than an increasing slope of the vertical pitch in the second region.

8. The shadow mask according to claim 7, wherein the first point P1(x1,y1 ) is in a range between $0.9Xe\geqq x\mathbf{1}\geqq 0.97Xe$ and $0.9Ye\geqq y\mathbf{1}\geqq 0.97Ye$.

* * * * *